US007186349B2

(12) United States Patent
Hu et al.

(10) Patent No.: US 7,186,349 B2
(45) Date of Patent: Mar. 6, 2007

(54) FLUID EJECTION DEVICE AND METHOD OF FABRICATING THE SAME

(75) Inventors: Hung-Sheng Hu, Kaohsiung (TW); Wei-Lin Chen, Taipei (TW)

(73) Assignee: Benq Corporation, Taoyuan (TW)

( * ) Notice: Subject to any disclaimer, the term of this patent is extended or adjusted under 35 U.S.C. 154(b) by 271 days.

(21) Appl. No.: 10/980,958

(22) Filed: Nov. 4, 2004

(65) Prior Publication Data

US 2005/0093106 A1 May 5, 2005

(30) Foreign Application Priority Data

Nov. 4, 2003 (TW) ..... 92130744 A

(51) Int. Cl.
*B41J 2/16* (2006.01)

(52) U.S. Cl. ..... 216/27; 216/2; 216/33; 216/36; 216/56; 216/79; 216/99; 29/890.1; 438/21

(58) Field of Classification Search ..... None
See application file for complete search history.

(56) References Cited

U.S. PATENT DOCUMENTS 4,875,968 A * 10/1989 O'Neill et al. ..... 216/27
4,878,957 A * 11/1989 Yamaguchi et al. ..... 148/33.3
5,441,600 A * 8/1995 Smits ..... 216/51
6,033,581 A * 3/2000 Kobayashi ..... 216/27
6,273,553 B1 * 8/2001 Kim et al. ..... 347/48
6,449,831 B1 * 9/2002 Komplin et al. ..... 29/611
6,883,903 B2 * 4/2005 Truninger et al. ..... 347/71

FOREIGN PATENT DOCUMENTS

JP 07335511 A * 12/1995

* cited by examiner

*Primary Examiner*—Anita Alanko
(74) *Attorney, Agent, or Firm*—Thomas, Kayden, Horstemeyer & Risley

(57) ABSTRACT

A fluid ejection device includes a first substrate having a first crystal orientation, a second substrate having a second crystal orientation, bound to the first substrate, a manifold through the first and second substrates, a chamber formed in the second substrate, connected with the manifold, and a plurality of nozzles connecting to the chamber, wherein the first crystal orientation is different from the second crystal orientation. A method of fabricating the same is also disclosed.

21 Claims, 4 Drawing Sheets

FLUID EJECTION DEVICE AND METHOD OF FABRICATING THE SAME

BACKGROUND OF THE INVENTION

1. Field of the Invention

The present invention relates to a semiconductor device, and more specifically to a fluid ejection device and a method of fabricating the same.

2. Description of the Related Art

Strong basic solutions, such as TMAH, KOH, or NaOH, are commonly used as etching solutions in silicon fabrication processes. Such solutions offer different etching performance for various monosilicon crystal planes. Although etching performance for various crystal planes may have slight distinctions due to different kinds or concentration of etching solution, or different etching temperatures, the etching rates for various crystal planes is approximately (111)<(110)<(100), specifically, the etching rate for crystal plane (111) is far slower than for others.

FIG. 1 and FIG. 2 illustrate the etching performance of a strong basic solution for various crystal planes. Referring to FIG. 1, the crystal plane (100) is etched to form an anisotropic etching track with an included angle of 54.7° in substrate 10. In FIG. 2, which shows the etching result of the crystal plane (111), a vertically anisotropic etching track is formed in substrate 10.

Therefore, a manifold with a back opening larger than a front opening is formed in the chip (100) while etching the back thereof is performed, for example, a back opening width of a manifold with a front opening width of about 200 μm is enlarged to about 1100~1200 μm during etching the back of the chip. Thus, the manifold formed in chip (100) occupies the majority of a wafer, and substantially reduces the available area thereon.

Additionally, during assemble, a chip must provide sufficient space for binding with a cartridge. Generally, the width of the binding region at the left and right sides of a chip is about 1200 μm respectively. Thus, a chip should provide a bottom region width of at least 3500~3600 μm for fabricating a fluid ejection device, thereby reducing availability in the bottom area thereon.

Currently, the original substrate (100) is replaced by a substrate (111) to reduce the back opening size of a manifold. Nevertheless, although the back opening width thereof can be reduced due to specific etching performance, the manifold shape may slant to result in an unexpected chamber shape, deteriorating the dispersion effect of the device.

Referring to FIG. 3, a conventional fluid ejection device comprises a silicon substrate 10, a manifold 20 used to transport fluid, chambers 30 formed in both sides of the manifold 20 to store fluid, and a plurality of nozzles 40 installed on the device surface to ejection fluid.

According to the above device structure, the back opening is larger than the front opening of the manifold, thus the back opening occupies the majority of the wafer, and substantially reduces the available area thereon.

Additionally, a conventional fabrication method for a fluid ejection device is disclosed in the following description, and illustrated in FIGS. 4*a* to 4*b*. Referring to FIG. 4*a*, a substrate 10, such as a silicon substrate with crystal orientation (100) is provided. A patterned sacrificial layer 20 is formed on the substrate 10. The sacrificial layer 20 is composed of BPSG, PSG, or silicon oxide, preferably PSG. Subsequently, a patterned structural layer 30 is formed on the substrate 10 to cover the patterned sacrificial layer 20.

The structural layer 30 includes silicon oxide nitride formed by chemical vapor deposition (CVD).

Next, a patterned resist layer 40 is formed on the structural layer 30 as an actuator, such as a heater. The resist layer 40 comprises $HfB_2$, TaAl, TaN, or TiN. A patterned isolation layer 50 is then formed to cover the substrate 10 and the structural layer 30, and a heater contact 45 is formed thereon. Subsequently, a patterned conductive layer 60 is formed on the structural layer 30 to fill the heater contact 45 to form a signal transmission line 62. Finally, a protective layer 70 is formed on the isolation layer 50 and the conductive layer 60, exposing the conductive layer 60 to form a signal transmission line contact 75, thereby facilitating the subsequent packaging process.

Subsequently, referring to FIG. 4*b*, the back of the substrate 10 is etched by wet etching using KOH as an etching solution to form a manifold 80, and exposes the sacrificial layer 20. The sacrificial layer 20 is then etched by HF to form a chamber 90. Finally, the protective layer 70, the isolation layer 50, and the structural layer 30 are then etched in order to form a nozzle 95 connecting the chamber 90.

The back opening is larger than the front opening of the manifold 80 due to the specific crystal orientation (100) of the substrate 10, and thereby occupies excessive bottom area on the wafer.

SUMMARY OF THE INVENTION

In order to solve the conventional problems, an object of the invention is to provide a fluid ejection device to effectively reduce the size of a back opening of a manifold, and control a chamber shape by providing a double substrate layer.

To achieve the above objects, the invention provides a fluid ejection device including a first substrate having a first crystal orientation, a second substrate having a second crystal orientation, bound to the first substrate, wherein the first crystal orientation is different from the second crystal orientation, a manifold through the first and second substrates, a chamber formed in the second substrate, connected with the manifold, and a plurality of nozzles connecting the chamber.

Based on the device structure of the invention, the substrate (111) is first etched to form a vertical etching track therein, as it will reduce the back opening width of the manifold. The substrate (100) is then etched to form another etching track therein, controlling the shape of the subsequently formed chamber.

Another object of the invention is to provide a method of fabricating the fluid ejection device, including the following steps. A first substrate having a first crystal orientation is provided. A second substrate having a second crystal orientation is provided to bind to the first substrate, wherein the first crystal orientation is different from the second crystal orientation. Subsequently, a patterned sacrificial layer is formed on the second substrate, as a predetermined region where at least one chamber is subsequently formed.

Next, a patterned structural layer is formed on the second substrate to cover the patterned sacrificial layer. A manifold through the first and second substrates is then formed to expose the patterned sacrificial layer. Subsequently, the sacrificial layer is removed to form the chamber. The chamber is continuously etched to enlarge the volume thereof so as to occupy a portion of the second substrate. Finally, the structural layer is etched to form at least one nozzle connecting the chamber.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
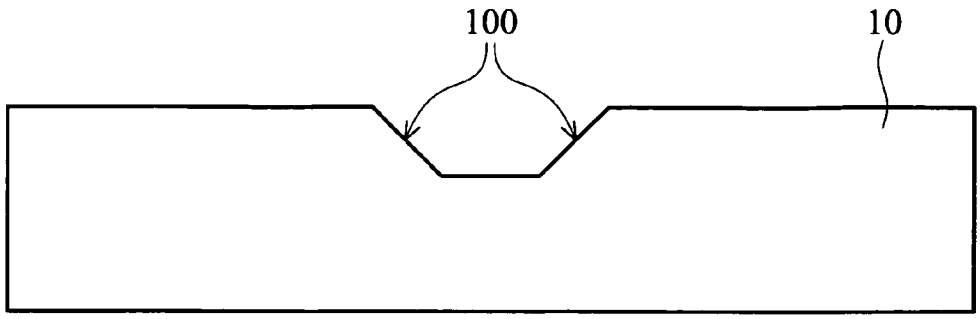
FIGS. 1~2 are cross sections illustrating etching performance for various crystal planes.
Figure 2:
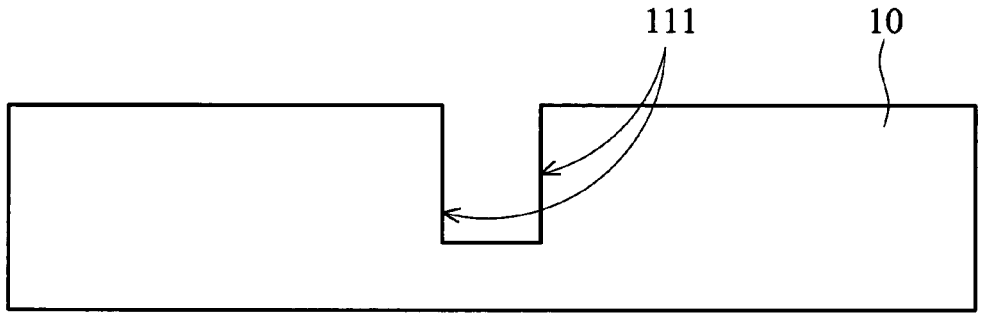
Figure 3:
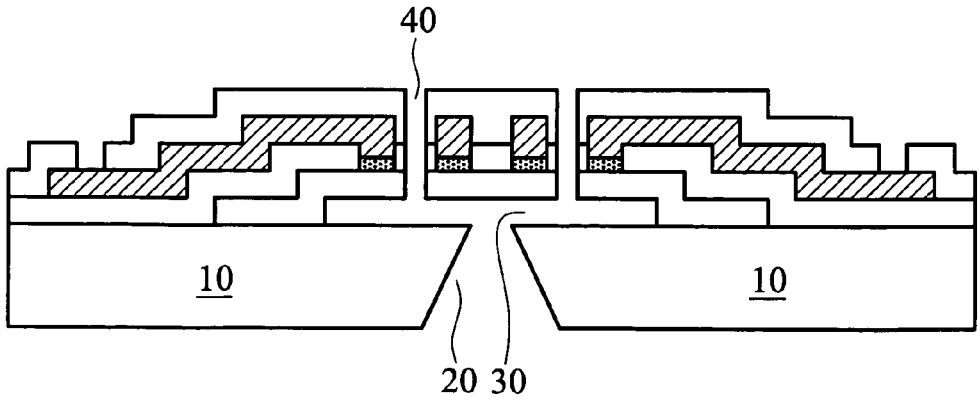
FIG. 3 ( RELATED ART )
FIG. 3 is a cross section of a conventional fluid ejection device.
Figure 4A:
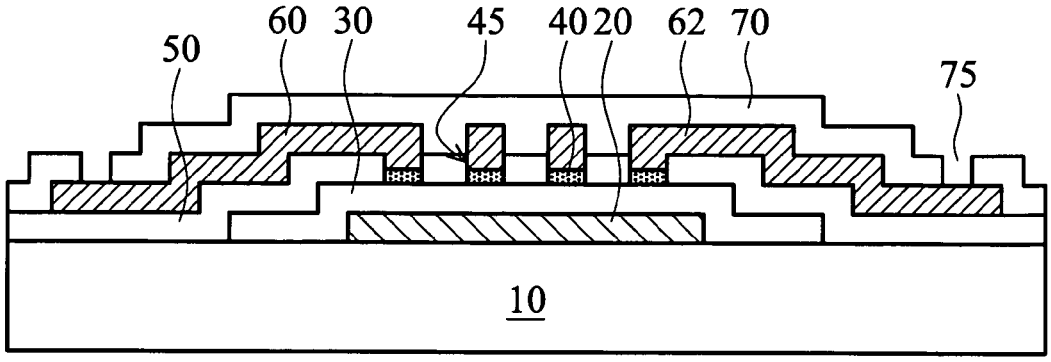
FIG. 4a ( RELATED ART )
FIGS. 4*a*~4*b* are cross sections illustrating fabrication of a conventional fluid ejection device.
Figure 4B:
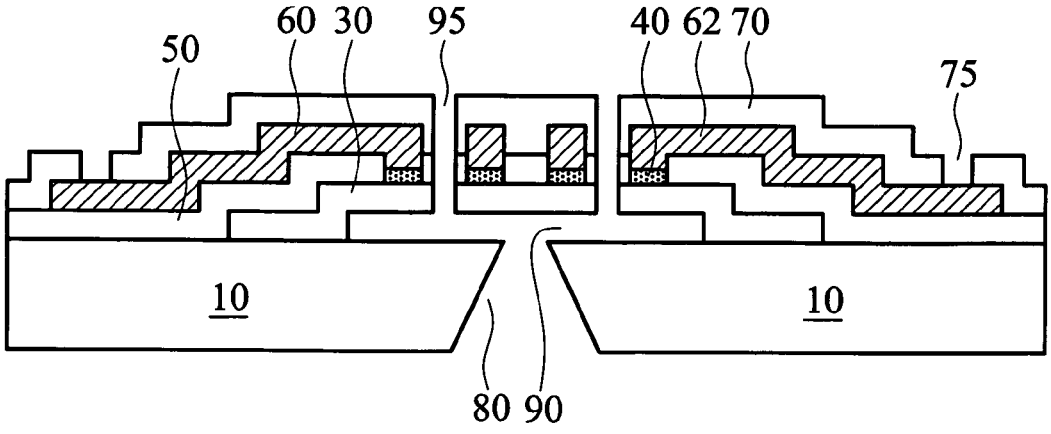
FIG. 4b ( RELATED ART )
Figure 5A:
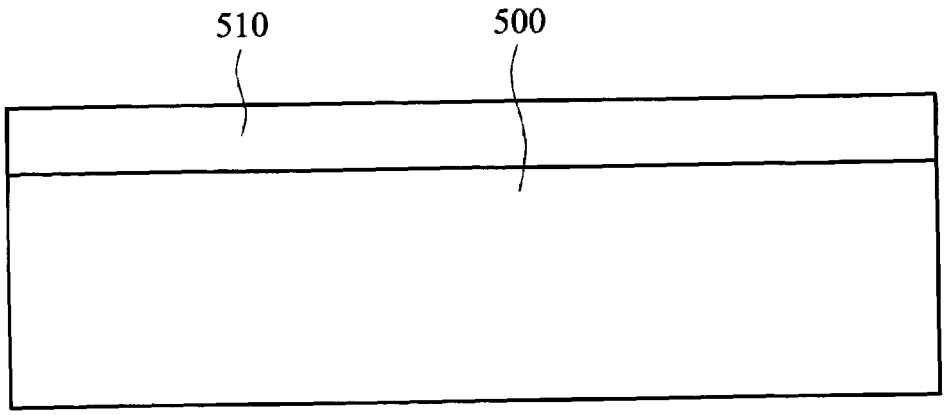
FIGS. 5*a*~5*c* are cross sections illustrating the method of fabricating a fluid ejection device in an embodiment of the invention.
Figure 5B:
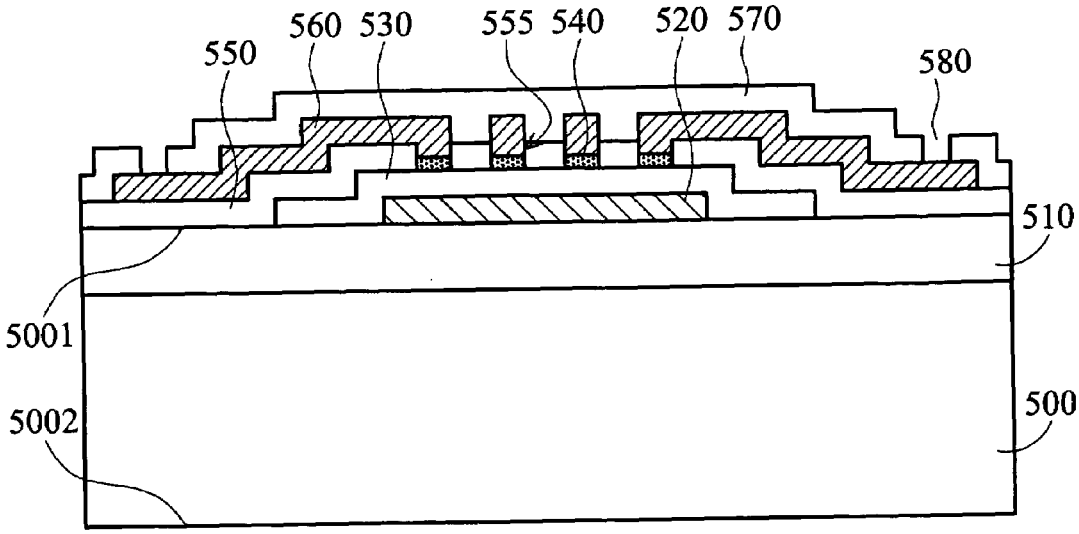
Figure 5C:
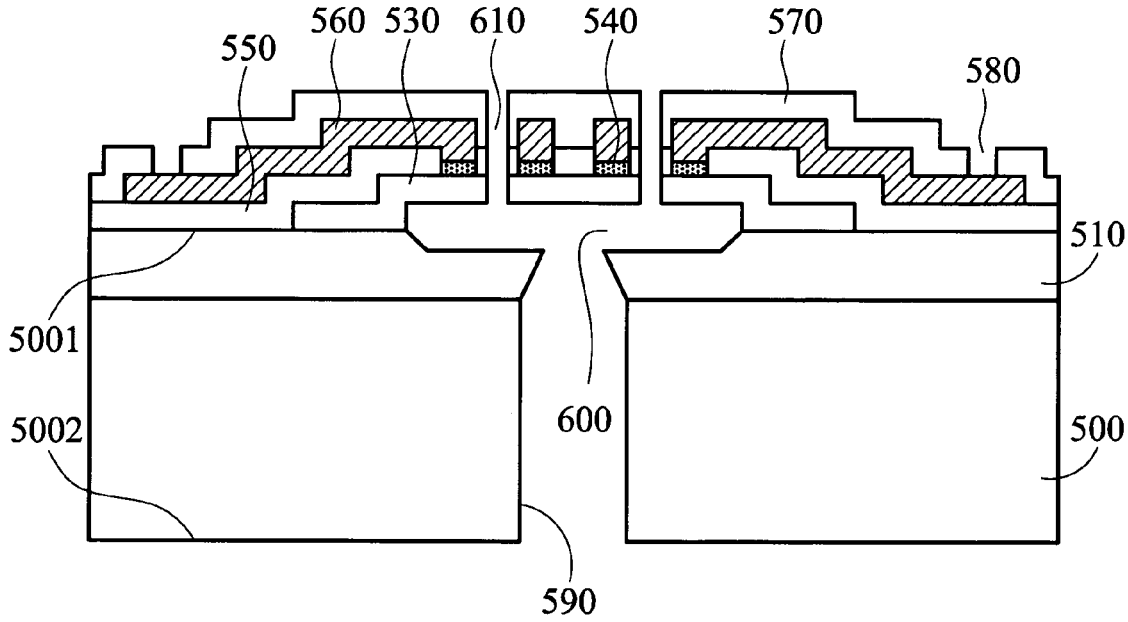

FIGS. 5*a*~5*c* illustrate the method of fabricating the fluid ejection device according to the invention.

In FIG. 5*a*, in which the initial step of the invention is illustrated, a first substrate 500 and a second substrate 510 are provided, wherein the first substrate 500 is a silicon substrate with crystal orientation (111) and the second substrate 510 is a silicon substrate with crystal orientation (100). The thickness ratio of the first substrate 500 and the second substrate 510 is about 10:1, wherein the thickness of the first substrate 500 is about 500~675 μm, and the thickness of the second substrate 510 is about 30~50 μm.

The second substrate 510 binds to the first substrate 500 by direct binding or medium binding, wherein the direct binding temperature is about above 1000° C., and the medium is oxide.

Subsequently, referring to FIG. 5*b*, a patterned sacrificial layer 520 is formed on a first plane 5001 of the second substrate 510. The sacrificial layer 520 is composed of BPSG, PSG, or silicon oxide, preferably PSG. The thickness of the sacrificial layer 520 is about 5000~20000 Å. The sacrificial layer 520 is a predetermined region where at least one chamber is subsequently formed.

Next, a patterned structural layer 530 is formed on the second substrate 510 to cover the patterned sacrificial layer 520. The structural layer 530 may include silicon oxide nitride formed by CVD. The thickness of the structural layer 530 is about 0.5~2 μm. Additionally, the structural layer 530 comprises a low-stress material, and the stress thereof is about 50~200 MPa.

Subsequently, a patterned resist layer 540 is formed on the structural layer 530, as a fluid ejection actuator, such as a heater, thereby driving fluid out of subsequently formed nozzles. The resist layer 540 comprises $HfB_2$, TaAl, TaN, or TiN, and is preferably TaAl.

A patterned isolation layer 550 is then formed to cover the structural layer 530, and a heater contact 555 is formed. Subsequently, a patterned conductive layer 560 is formed on the isolation layer 550 to fill the heater contact 555 to form a signal transmission line. Finally, a protective layer 570 is formed on the second substrate 510 to cover the isolation layer 550 and the conductive layer 560, exposing the conductive layer 560 to form a signal transmission line contact 580, thereby facilitating the subsequent packaging process.

Subsequently, referring to FIG. 5*c*, a series of etching steps are performed. First, a second plane 5002 of the first substrate 500 is etched to form a portion of the manifold 590 by anisotropic wet etching using TMAH, KOH, or NaOH as an etching solution.

During the above etching, the substrate 500 with crystal orientation (111) is etched to form a vertical etching track therein, thus reducing the back opening width of the manifold, and significantly increasing the available area on the first substrate 500.

Next, the second substrate 510 with crystal orientation (100) is etched to achieve the manifold fabrication, and exposes the sacrificial layer 520. The shape of subsequently formed chambers can be controlled by the manifold structure through the first and second substrates.

The narrow opening width of the manifold 590 is about 160~200 μm. Compared to the related art wherein the back opening width is about 1100~1200 μm, the occupied area on the chip bottom of the present invention is significantly reduced. Additionally, the manifold 590 connects to a fluid storage tank.

Next, the sacrificial layer 520 is etched to form chambers 600 by HF, and subsequently etched by a basic etching solution, such as KOH or NaOH, to enlarge the volume thereof, thus occupying a portion of the second substrate 510.

Finally, the protective layer 570, the isolation layer 550, and the structural layer 530 are etched in order by laser or reactive ion etching (RIE) to form nozzles 610 connecting to the chambers 600 which are connected to the manifold 590.

Additionally, if the resolution of a single row of chambers is 300 dpi, resolution can be increased to 600~1200 dpi by staggering each row of chambers in the embodiment.

In conclusion, the double substrate layer structure of the present invention can reduce the occupied area on a chip bottom, and provide preferable chamber shape to stably eject fluid.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of fabricating a fluid ejection device, comprising:

providing a first substrate having a first crystal orientation;

binding a second substrate having a second crystal orientation to the first substrate, wherein the first crystal orientation is different from the second crystal orientation;

forming a patterned sacrificial layer on the second substrate;

forming a structural layer on the second substrate, covering the patterned sacrificial layer;

forming a manifold through the first and second substrates, exposing the patterned sacrificial layer;

removing the sacrificial layer to form at least one chamber;

etching the chamber to enlarge the volume thereof; and forming at least one nozzle through the structural layer, connecting to the chamber.

2. The method as claimed in claim 1, wherein the first crystal orientation is (111), and the second crystal orientation is (100).

3. The method as claimed in claim 1, wherein the thickness ratio of the first and second substrate is about 10:1.

4. The method as claimed in claim 1, wherein the thickness of the first substrate is about 500~675 μm and the second substrate is about 30~50 μm.

5. The method as claimed in claim 1, wherein the binding method of the first and second substrates comprises direct binding and medium binding.

6. The method as claimed in claim 5, wherein the direct binding temperature is about above 1000° C.

7. The method as claimed in claim 5, wherein the medium is an oxide.

8. The method as claimed in claim 1, wherein the sacrificial layer is composed of BPSG, PSG, and silicon oxide.

9. The method as claimed in claim 1, wherein the thickness of the sacrificial layer is about 0.5~2 μm.

10. The method as claimed in claim 1, wherein the structural layer is composed of silicon oxide nitride.

11. The method as claimed in claim 1, wherein the thickness of the structural layer is about 0.5~2 μm.

12. The method as claimed in claim 1, wherein the structural layer comprises a low-stress material.

13. The method as claimed in claim 12, wherein the stress is about 50~200 MPa.

14. The method as claimed in claim 1, wherein the narrow opening width of the manifold is about 160~200 μm.

15. The method as claimed in claim 1, wherein the manifold is formed by an isotropic wet etching.

16. The method as claimed in claim 15, wherein the etching solution is KOH.

17. The method as claimed in claim 1, wherein the sacrificial layer is removed by wet etching.

18. The method as claimed in claim 1, wherein the etching solution is HF.

19. The method as claimed in claim 1, wherein the chamber is etched by wet etching.

20. The method as claimed in claim 19, wherein the etching solution is KOH.

21. The method as claimed in claim 1, wherein nozzles are formed by laser or reactive ion etching (RIE).

* * * * *